US005625345A

United States Patent [19]

Stark et al.

[11] Patent Number: 5,625,345

[45] Date of Patent: Apr. 29, 1997

[54] FIRE SAFETY APPARATUS

[76] Inventors: Patrick B. Stark, 5045 Bradford Ct., Brighton, Mich. 48116-9060; Paul Schepp, 41862 Metaline Dr., Canton, Mich. 48187

[21] Appl. No.: 440,355

[22] Filed: May 8, 1995

Related U.S. Application Data

[63] Continuation-in-part of Ser. No. 342,862, Nov. 21, 1994, abandoned, which is a continuation of Ser. No. 987,747, Dec. 8, 1992, abandoned.

[51] Int. Cl.[6] ..... G08B 21/00

[52] U.S. Cl. ..... 340/628; 340/521; 340/518; 340/620

[58] Field of Search ..... 340/628, 632, 340/618, 604, 620, 521

[56] References Cited

U.S. PATENT DOCUMENTS

| | | | |
|---|---|---|---|
| 3,860,919 | 1/1975 | Aker | 340/628 |
| 3,872,419 | 3/1975 | Groves et al. | 338/25 |
| 4,075,614 | 2/1978 | White | 340/628 |
| 4,623,878 | 11/1986 | Schoenwetter | 340/628 |
| 4,659,909 | 4/1987 | Knutson | 340/628 |
| 4,796,017 | 1/1989 | Merenda | 340/620 |
| 4,797,772 | 1/1989 | Kaplanis | 361/42 |
| 4,841,282 | 6/1989 | Reis | 340/521 |
| 5,012,223 | 4/1991 | Griebell et al. | 340/531 |
| 5,031,702 | 7/1991 | Trumbach | 169/61 |

*Primary Examiner*—Jeffery Hofsass
*Assistant Examiner*—Edward Lefkowitz
*Attorney, Agent, or Firm*—Harness, Dickey & Pierce, P.L.C.

[57] ABSTRACT

A fire safety apparatus particularly useful in association with Christmas trees comprising a smoke detector, circuitry for processing a signal generated by the smoke detector, an audible alarm, a moisture level sensor and circuitry for interruption of the flow of electricity to a receptacle. In the event of a Christmas tree fire, the smoke detector activates the circuitry which cause the audible alarm to be sounded. The audible alarm is sensed by a receiver which contains the circuitry for interruption of the flow of electricity and is in the form of one or more switches. Any appliances, such as Christmas tree lighting which are plugged into the receptacle, are deactivated by the interruption of electrical flow at the receptacle. Additionally, moisture sensing probes are provided which activate circuitry which cause the alarm to be sounded when the moisture level contained in a Christmas tree base falls below a certain level. Again, the circuitry activates one or more switches, thereby precluding the flow of electricity to the appliances plugged into the receptacle.

5 Claims, 5 Drawing Sheets

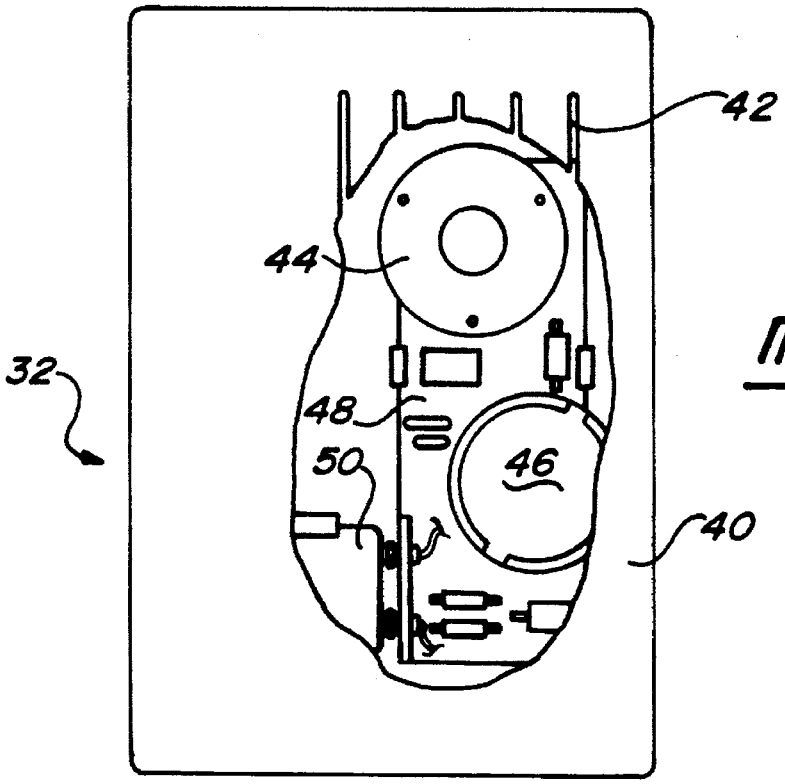
Fig - 2
Fig - 4
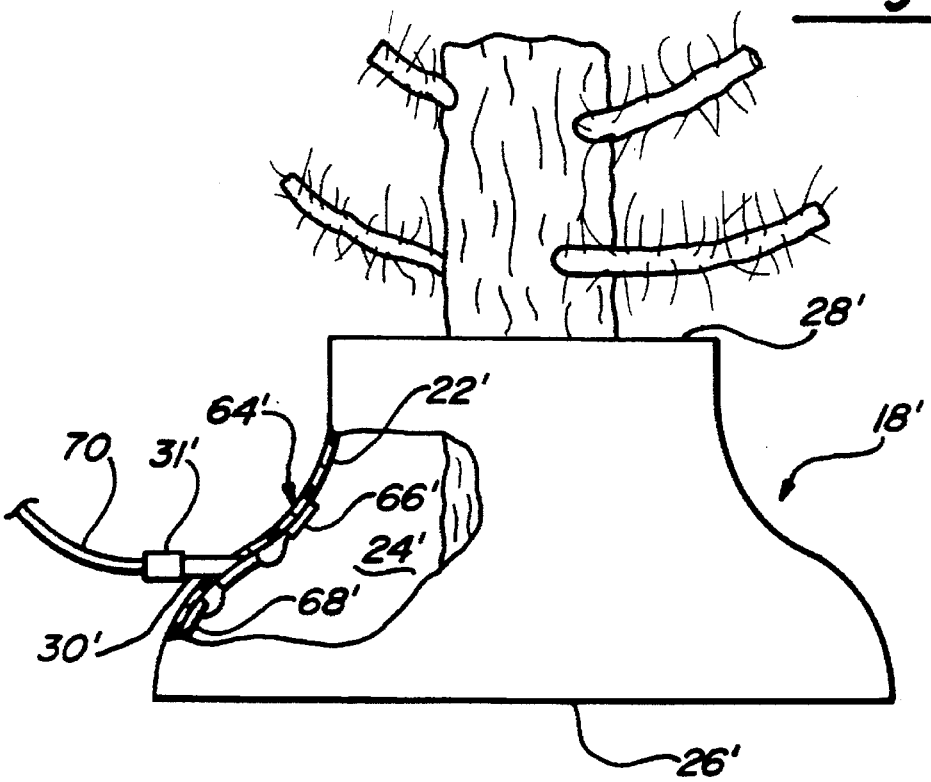

FIRE SAFETY APPARATUS

CROSS-REFERENCE TO RELATED APPLICATIONS

The present application is a continuation-in-part application of U.S. patent application Ser. No. 08/342,862, filed Nov. 21, 1994, and entitled "Fire Safety Apparatus" abandoned, which in turn is a continuation of U.S. patent application Ser. No. 07/987,747, filed Dec. 8, 1992, entitled "Fire Safety Apparatus", abandoned.

BACKGROUND OF THE INVENTION

1. Field of the Invention

This invention relates generally to a fire safety apparatus, and more particularly, to a fire prevention, limitation and alarm system for fires caused by lights suspended upon a Christmas tree.

2. Description of Related Art

During the Christmas season, often fires occur as a direct result of faulty Christmas tree lighting. Christmas trees tend to become dried out and susceptible to ignition in this condition, thereby limiting the reaction time available to individuals to preclude serious damage or injury.

There are devices currently available or which have been available in the past which are intended to notify of a dangerous condition by sounding an alarm. These devices utilize any one of a number of different detection means such as temperature sensors, light reflection sensors, and unburned hydrocarbon sensors, such as the Taguchi gas sensor, among others.

U.S. Pat. No. 3,860,919 to Acre, entitled "Smoke and Gas Detection and Alarm Apparatus" which issued Jan. 14, 1975, discloses an improved Taguchi gas sensor type detection and alarm system for smoke, gas or the like, which is particularly adapted for use in environments where the only source of electrical operative power is an ordinary storage battery. The storage battery provides for both the low voltage, high current electrical power required for activating the Taguchi gas sensor and an audio frequency output signal for operating an audible warning component of the system when the sensor has detected the presence of smoke, gases or the like.

U.S. Pat. No. 4,623,878 to Schoenwetter, entitled "Christmas Tree Mounted Smoke Detector" which issued Nov. 18, 1986, discloses a smoke alarm mounted to the top of a Christmas tree which comprises an alarm having a built-in ionization chamber for detecting smoke, control circuits for operating the ionization chamber and circuitry for processing and interrupting the output signals from the ionization chamber. In the event smoke is detected, the control circuit operates an alarm which generates a loud audible signal to warn individuals in the vicinity.

The present invention relates to a fire safety apparatus useful for limiting, and preferably preventing, dangerous conditions such as fires and more particularly, Christmas tree fires. The fire safety apparatus of the present invention typically includes three main components. The first component is a detector which includes smoke sensing means, circuitry for processing the signal generated by the smoke sensing means and an audible alarm. The second component includes a receiver and circuit interruption means for precluding the flow of electricity. The third component includes moisture sensor means which are connected to the circuitry contained in the detector component to cause the flow of electricity to become interrupted via the circuitry of the second component and activate an audible alarm.

It is therefore a primary object of the present invention to provide a fire safety apparatus wherein the detector is adaptable to be appended to a Christmas tree such that upon activation an audible alarm is sounded which warns of impending dangerous conditions. The audible alarm also activates circuit interruption means to preclude the flow of electricity to the Christmas tree lights.

It is another object of the present invention to provide a smoke detector which can be positioned in various locations to warn of a fire.

It is yet another object of the present invention to provide a moisture level sensor which activates circuitry causing an audible alarm to be sounded to worn of impending dangerous conditions. The audible signal also triggers circuit interruption means to preclude the flow of electricity to the Christmas tree lights.

It is still another object of the present invention to provide a test means for ensuring that the audible signal and shutdown circuits are operative.

A further object of the present invention is to provide a wireless operation between smoke detection means and an electricity shut-off mechanism.

Another object of the present invention is to provide a combined smoke and moisture level detector which is easy to manufacture and set up.

Still another object of the present invention is to provide a moisture level detector which is integral with the Christmas tree stand.

Additional objects and advantages of the present invention will become apparent from reading of the detailed description of the preferred embodiments which make reference to the following set of drawings in which:

BRIEF DESCRIPTION OF THE DRAWINGS

FIG. 2 is a frontal view of the smoke detector according to the teachings of the present invention with the housing removed;

FIG. 4 is a partial elevation view demonstrating a Christmas tree stand having an integral probe for signalling a low volume of water according to the teachings of the present invention;

DETAILED DESCRIPTION OF THE PREFERRED EMBODIMENT

Figure 1:
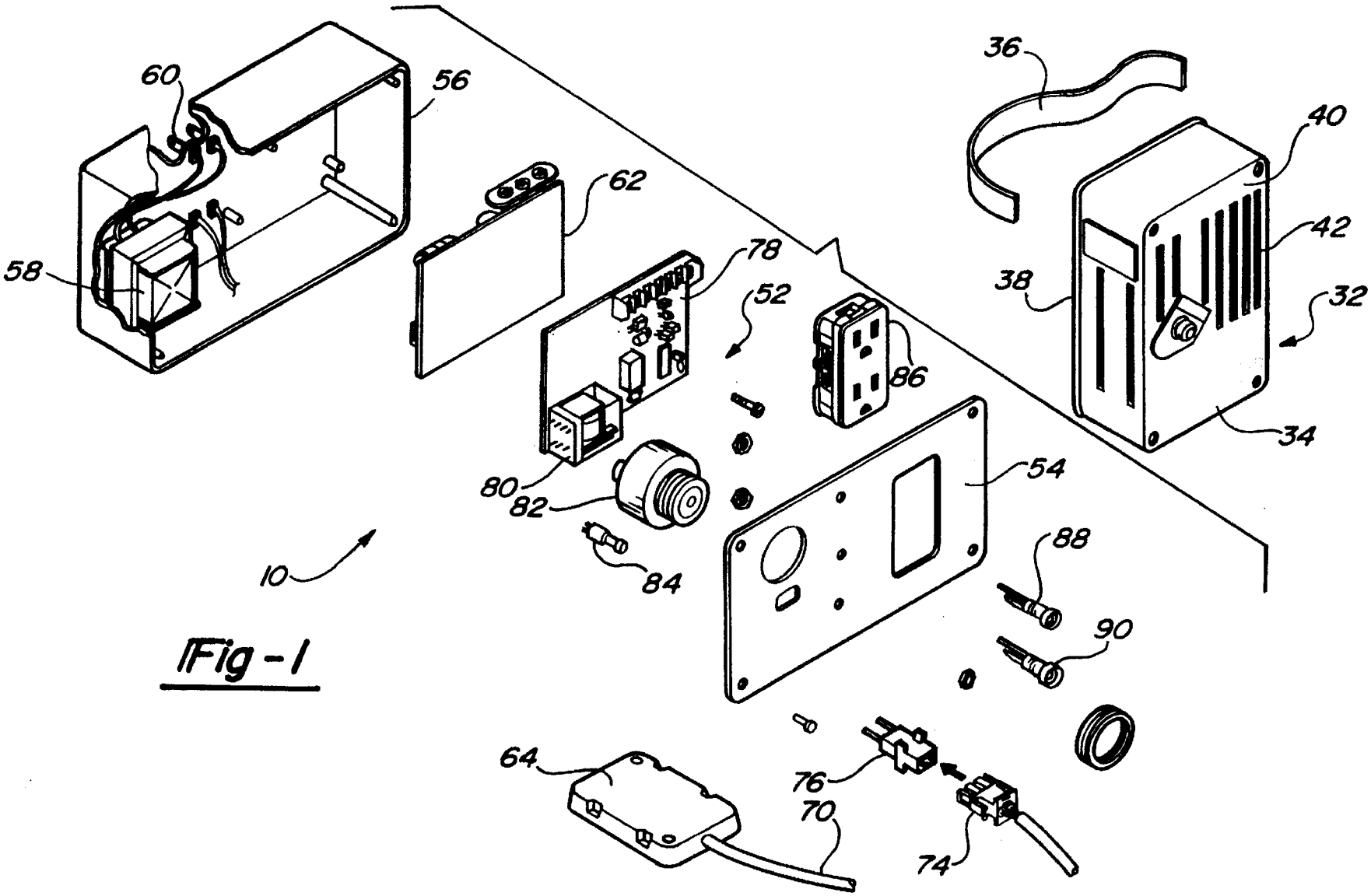
FIG. 1 is an exploded perspective view of a fire safety apparatus according to the teachings of the present invention.
Figure 3:
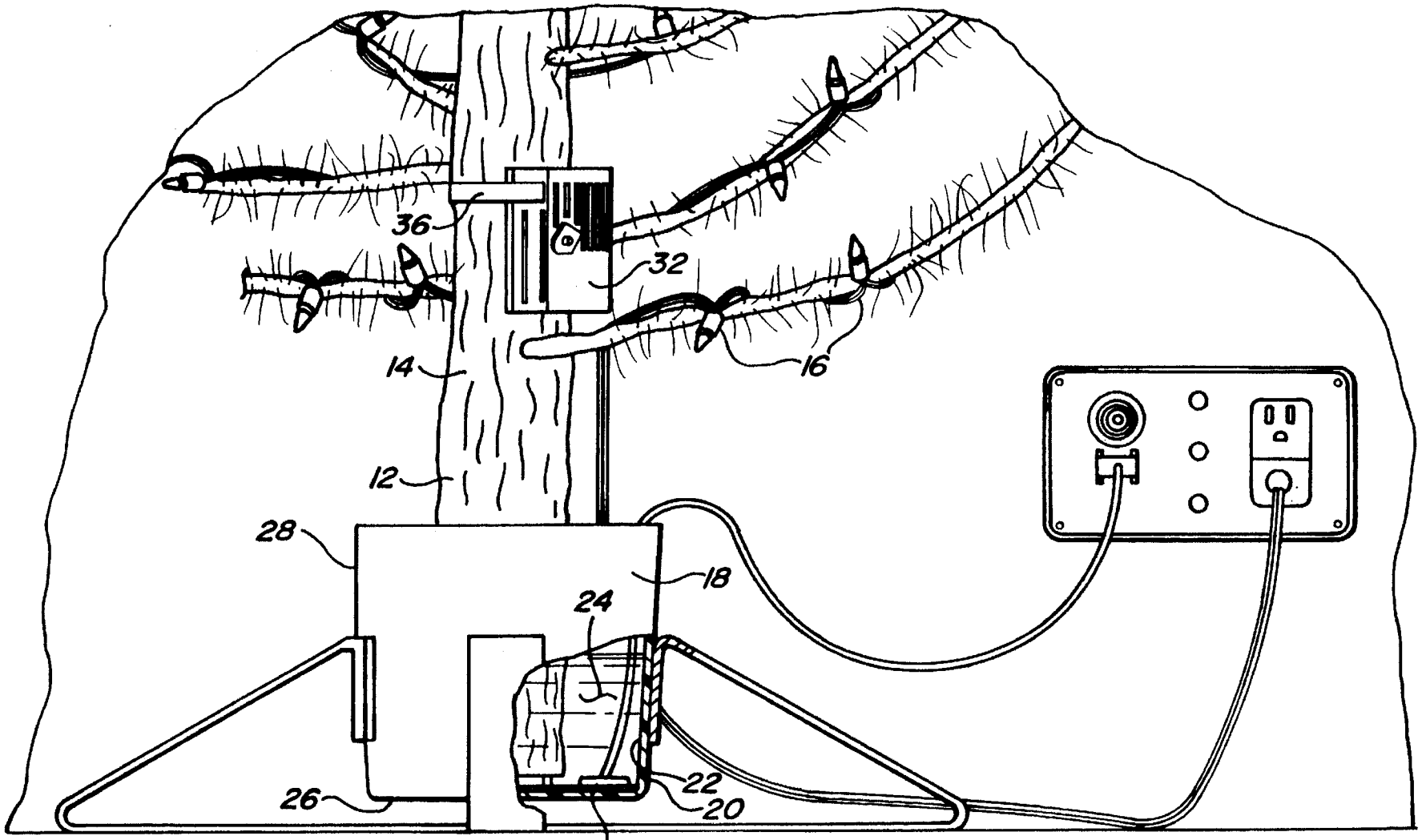
FIG. 3 is an operational view of the fire safety apparatus according to the teachings of the present invention.

Referring to FIGS. 1 and 2 the fire safety apparatus 10 of the present invention is shown. The major components of the fire safety apparatus of the present invention include a smoke detector 32, a water sensing probe 64 and a shut-off mechanism 52 for interrupting the flow of electricity to an electrically driven object. While the fire safety apparatus of the present invention is described as being useful to limit the likelihood of serious damage caused by Christmas tree fires due to faulty wiring in Christmas tree lights 16, or over heating, it will be apparent to those skilled in the art that the apparatus is adaptable for a variety of other uses. The invention is particularly useful in association with Christmas tree lights to be hung on a natural tree, however the invention may also be utilized with artificial trees as well.

The smoke detector 32 is selectively attachable to a substrate and most preferably to the stem of a Christmas tree by positioning the casing 34 of the smoke detector against the stem 14 of the Christmas tree 12 and securing the smoke detector 32 in that position. In the preferred embodiment, a Velcro® strap 36 is adhered to the casing 34 and is wrapped around the stem of the tree. The casing 34 consists of a back plate 38 and a housing 40 having a plurality of openings 42 therethrough to allow air to circulate within the casing 34.

As shown more clearly in FIG. 2 the smoke detector components contained within the casing 34 typically include an audible alarm 44, an ionization sensor 46, circuitry 48 for transmitting a signal generated by the ionization sensor and a battery 50 for energizing the smoke detector.

The shut-off mechanism 52 for interrupting the flow of electricity to the Christmas tree lights or another electrically driven object includes a cover plate 54 and a housing 56 for hosting the internal components. The internal components of shut-off mechanism 52 include a power supply 58 which is connected to a prong 60 to be plugged into a wall socket (not shown). Various commercially available power supplies can be utilized with the present invention. The power supply 58 converts the voltage at the wall socket down to between 9 and 12 volts. Connected to the power supply 58 via wiring is a solid state water detector PCB 50. The solid state water detector 62 utilized in the present invention is a Winland Electronics Model #WB-300 available from Winland Electronics of Mankato, Minn. The water detector of the present invention is a low voltage-low current DC circuit designed to conduct or sense moisture up to approximately 300,000 ohms. Generally, tree sap alone should not be capable of providing this circuit. The water detector 62 is connected via wiring 70 to a water sensing probe 64 which extends outside of the housing 56. The water sensor probe 64 has a water sensor lead plug 74 located at one end which mates with a connector 76 which is attached to the water detector 62 to form the connection between the water detector 62 and the water probe 64. The water sensing probe 64 is a solid state device having a pair of spaced apart leads which form an oscillating circuit with the circuit being completed by a sufficient amount of water in the base of the Christmas tree stand 18. It should be noted that the water level sensor probe 64 can be disconnected when desirable, such as when the present invention is used in association with an artificial Christmas tree, by removing the lead plug 74 from the connector 76. A commercially available jumper plug (not shown) would then be plugged into the connector 76 in place of the lead plug 75 to complete the circuit.

Figure 5:
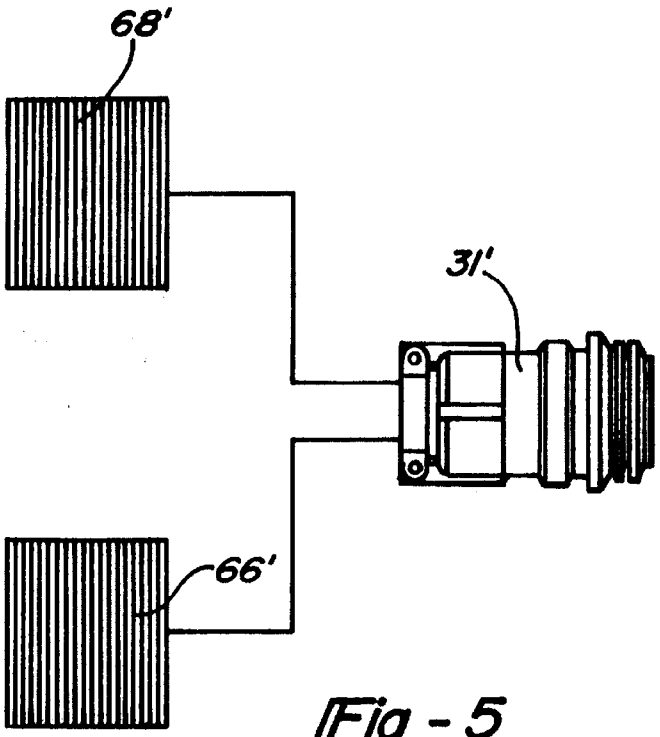
FIG. 5 is a schematic view demonstrating the probe assembly of FIG. 4 according to the teachings of the present invention.

Under an alternative embodiment the water sensing probe 64' is formed to be integral with a Christmas tree stand 18' as shown more clearly in FIG. 4. The bucket portion of the Christmas tree stand 18' is formed of an electrically non-conductive plastic material with first and second probe leads 66' and 68', respectively, extending from the inner surface 22' into the containment area 24' of the stand. Preferably, the Christmas tree stand has a wide bottom portion 26' and a narrower upper portion 28' for receiving the stem 14' of a Christmas tree 12'. This serves to protect the probe leads 66' and 68' from being contacted and damaged by the stem 14' of the tree. The probe leads pass through the body of the stand into a lead plug 30' for receiving a connector 31' which extends from a water detector shown in FIG. 1. The connector 31' as demonstrated in FIG. 5 may have a variety of different shapes.

Figure 6:
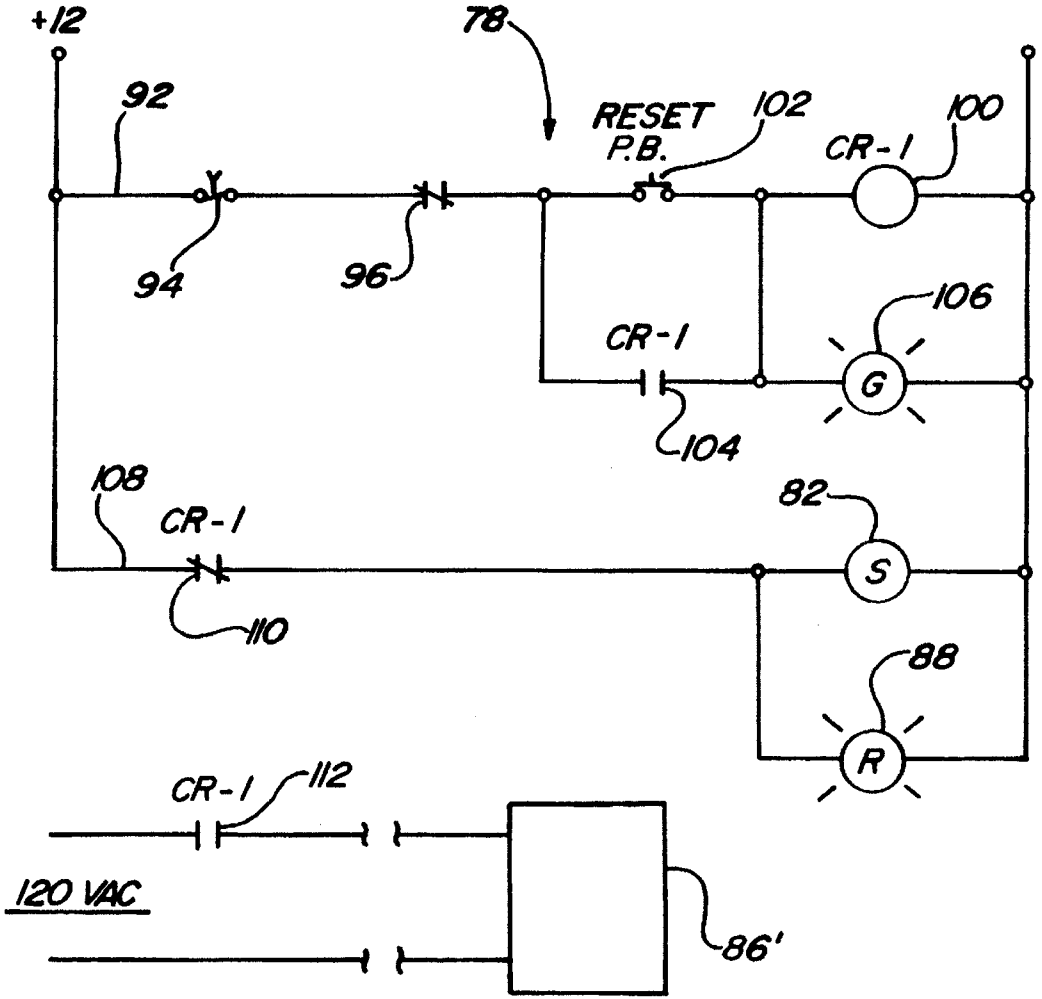
FIG. 6 is a ladder logic circuit diagram illustrating an enabling latch circuit according to the teachings of the present invention.

The water detector 62 is connected to an enabled latch circuit 78 having a wireless transmitter/receiver PCB 80 attached thereto such as the Linear Corporation Model #D-22A/D-67 shown in FIG. 1 or its equivalent. The latch circuit 78 is shown according to a ladder logic diagram provided in FIG. 6. Latch circuit 78 includes first and second circuit lines 92 and 108, respectively, which are powered by the 12 volt DC power supply 58. The first circuit line 92 includes a normally open but held closed relay contact 94 that operates off a relay in the water detector 62. A normally closed relay contact 96 is connected in series with relay contact 94 and is responsive to a relay found in the smoke circuit. A control relay (CR1) 100 is serially connected to a manually operated reset pushbutton contact 102 which in turn is connected in parallel with a normally open relay contact 104. In addition, a light emitting diode 106 is coupled in parallel to control relay 100 and provides light indication for enabled status.

The second line 108 of enabled latch circuit 78 includes a normally closed relay contact 110 coupled in series with a parallel connected piezoelectric alarm (S) 82 and the alarm status light emitting diode 88. Under normal operating conditions, relay contacts 94 and 96 remain closed. A momentary closing of contact 102 closes circuit line 92 thereby energizing control relay 100. Control relay 100 in turn closes relay contacts 104 and 112 and opens relay contact 110. Upon detection of an alarm condition, relay contact 94 and/or relay contact 96 opens to thereby re-energize control relay 100 which in turn closes relay contact 110 to energize piezoelectric alarm 82 and open relay contact 112 so as to disconnect power supplied to device receptacle 86. The alarm condition remains as is until the reset pushbutton 102 as shown in FIG. 1 is depressed and the alarm condition no longer exists.

Operationally, the fire safety apparatus 10 offers two methods of limiting, and preferably precluding, a potential hazardous condition. Although the method may be carried out utilizing the Christmas tree stand 18' having the water sensing probe 64' which is integral with the Christmas tree stand 18', the method will be described with reference to the water sensing probe 64 which is deposited into containment area 24 Christmas tree stand 18.

The first method involves detecting a low level of water in a Christmas tree stand to warn of impending dangerous conditions. Initially, the shut-off mechanism 52 for interrupting the flow of electricity to the Christmas tree lights 16 or other electrical object is plugged into a standard 120 volt electrical outlet. The water sensing probe 64 is then deposited into the containment area 24 of the Christmas tree stand 18 which is provided with an ample supply of water. The Christmas tree lights 16 are then plugged into the electrical receptacle 86 of mechanism 52 to illuminate the lights. In the event that the water level in the Christmas tree stand becomes low enough to cause the circuit across the water sensing probe 64 to become interrupted, a signal is generated by the water detector 62 and sent to the enabled latch circuit 78. The enabled latch circuit 78 then causes the transmitter 80 to send a signal activating the piezo-electric alarm 82 to sound to warn of impending dangerous conditions. Likewise, the enabled latch circuit 78 triggers a control relay switch 112 to open which interrupts the flow of electricity to the electrical receptacle 86 thereby causing the Christmas tree lights 16 to shut off. In the event that the embodiment includes enabled and alarm indicator lights 106 and 88, respectively, the enabled latch circuit is also activated such that the enabled light emitting diode 106 switch off and the alarm light emitting diode 88 becomes illuminated to give a visual signal warning of impending dangerous conditions.

The second method of limiting, and preferably precluding, the damage caused by a Christmas tree fire according to the present invention involves detecting an excess amount of hydrocarbons in the atmosphere in the event of a Christmas tree fire. The smoke detector 32 is typically positioned in close proximity to the Christmas tree such that a fire can be detected relatively soon after breaking out. As previously noted the smoke detector is equipped with a Velcro® strap 36 for attachment to the stem of the Christmas tree. If a fire does break out the ionization sensor 46 of the smoke detector 32 senses the excess hydrocarbons in the atmosphere and sends a signal to the circuitry 48 contained within the smoke detector. The circuit then signals the audible alarm 44 to activate. This audible signal is detected by the transmitter/receiver 80 of the shut-off mechanism 52 and a signal is sent to the enabled latch circuitry 78 of the shut-off mechanism 52. The circuitry 78 sends an electrical impulse which causes the piezo electric alarm 82 of the mechanism to sound thereby warning of impending dangerous conditions. Further, the enabled circuit 78 triggers a control relay switch 110 located on the circuit board to open which interrupts the flow of electricity to the electrical receptacle 86 thereby causing the Christmas tree lights to shut off. In the embodiments which are provided with indicator lights, when the circuit 78 receives a signal to trigger the alarm and shut off the flow of electricity to the receptacle 86, the circuit also causes the indicator lights to switch from "enabled" to "alarm" to give a visual signal warning of impending dangerous conditions.

Figure 7:
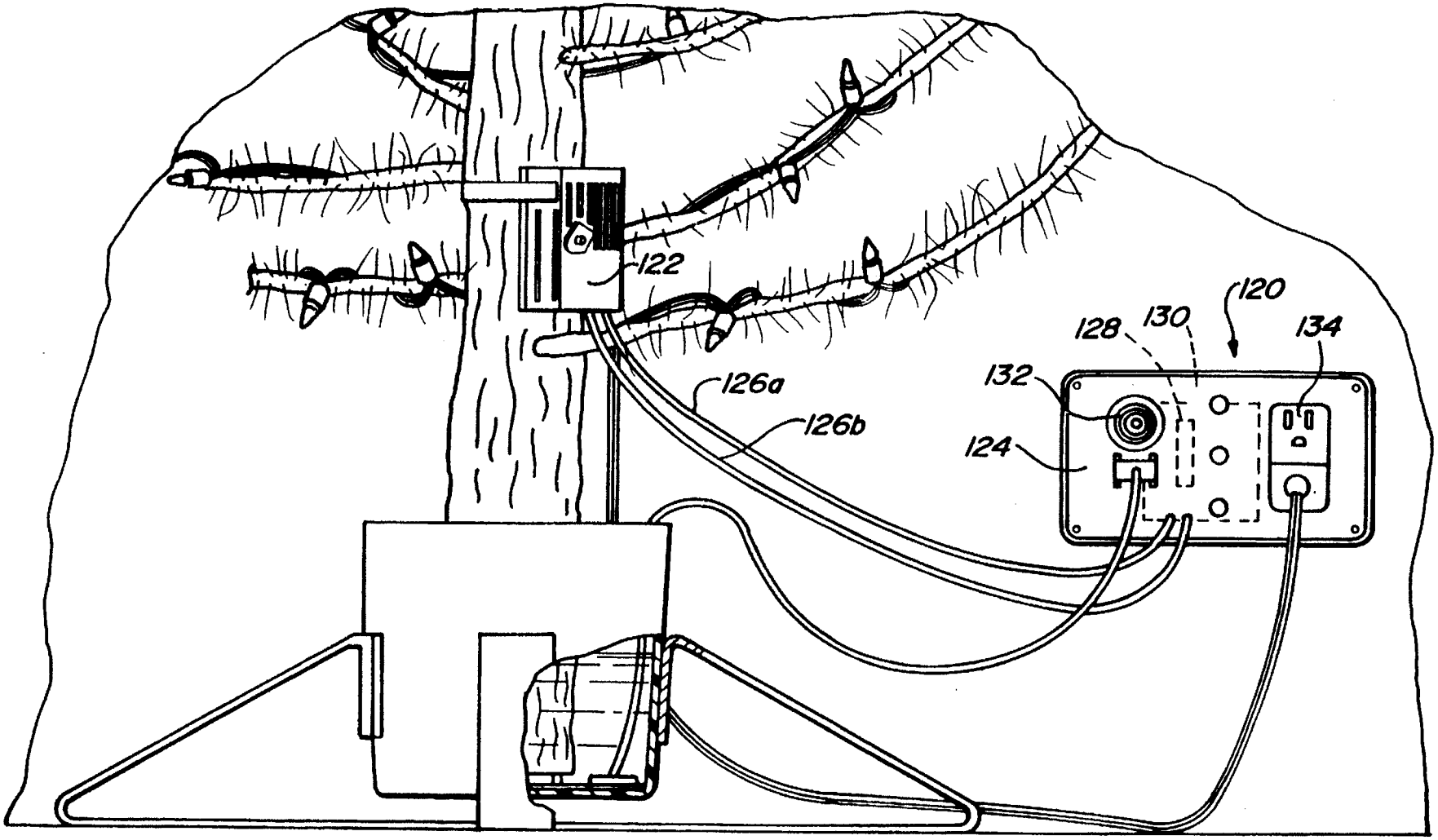
FIG. 7 is a schematic drawing of a monitoring/shut-off mechanism and smoke detector in accordance with an alternative preferred embodiment of the present invention.

Referring now to FIG. 7, an alternative preferred embodiment 120 of the present invention is shown. The embodiment 120 comprises a smoke detector 122 and a monitoring/shut-off mechanism 124 coupled together via a pair of electric cables 126*a* and 126*b*. The electrical cables 126 electrically couple the circuitry within the smoke detector 122 with a microcomputer 128 disposed on a printed circuit board 130 of the monitoring/shut-off mechanism 124. The microcomputer preferably comprises a Motorola HC 705KC1 microprocessor which essentially provides the functionality of the discrete components of the embodiments previously set forth herein in a single integrated circuit chip. It will be appreciated that the smoke detector 122 and monitoring/shut-off mechanism 124 are otherwise identical in construction and operation to the previously described embodiments of the smoke detector and shut-off mechanism.

By hardwiring the smoke detector 122 to the monitoring/shut-off mechanism 124, the overall cost of the system is reduced while providing several additional advantages. For example, the electrical cables 126*a* and 126*b*, which may comprise simply a pair of telephone grade conductors which are easily purchased and lengthened if needed, perform the functions of supplying the necessary power to the smoke detector 122 (in this case, 9 volts DC), providing the alarm signal to the monitoring/shut-off mechanism 124, and providing a "supervisory" or monitoring function with regard to the integrity of the wires. If the wires become shorted or open circuited, this condition is sensed by the microcomputer 128. Accordingly, even if the wires 126*a* and 126*b* are damaged by fire, the microcomputer 128 senses that the integrity of the conductors 126*a* and 126*b* has been compromised and causes an audible warning signal to be generated in response thereto. To facilitate this provision, the smoke detector 122 preferably contains a conventional "end-of-line" resistor within a circuit thereof which is used by the monitoring/shut-off mechanism 124 to achieve the above-described supervision. The monitoring/shut-off mechanism 124, and more particularly the microcomputer 128 thereof, constantly monitors the voltage across the end-of-line resistor using a conventional comparator circuit. Should this voltage change, the microcomputer 128 interprets the change as an alarm condition and activates an audible alarm 132 of the monitoring/shut-off mechanism 124. Also, should the user simply fail to plug in the wires 126*a* and 126*b* of the smoke detector 122 into the monitoring/shut-off mechanism 124, the microcomputer 128 causes a signal to be generated which activates the audible alarm 122 and prevents power from being coupled to an AC receptacle 134 of the monitoring/shut-off mechanism 124, thus preventing the Christmas tree lights from being utilized.

It will be appreciated then that the embodiment 120 described above not only provides the functions of detecting a smoke-present condition, but also provides a means by which monitoring of the electrical cables 126*a* and 126*b* are accomplished by the microcomputer 128 to thus ensure the integrity of the apparatus at all times.

To reactivate the fire safety apparatus the reset button must be depressed to re-energize the enabled latch circuit.

While the above detailed description describes the preferred embodiment of the present invention, it will be understood that the present invention is susceptible to modifications, variations and alterations without deviating from the scope and spirit of the subjoined claims.

What is claimed is:

1. A fire safety apparatus for monitoring the operation of electrical Christmas tree ornamentation equipment supported on a Christmas tree, said apparatus comprising:

a low water level detector for detecting a low water level within a tree stand in which a portion of said Christmas tree is disposed, said low water detector having a low water detector circuit for detecting the presence of low water and generating an electrical alarm signal in response to the detection of a low water condition;

a smoke detector releasably securable to a portion of said Christmas tree, said smoke detector having a smoke detector circuit for detecting the presence of smoke and a first audible alarm for generating a first audible alarm signal in response to the detection of smoke in the vicinity of said Christmas tree;

a shut-off mechanism adapted to be removably electrically coupled to an existing AC wall receptacle and also coupled to said low water level detector, said shut-off mechanism including a sensing circuit for sensing the presence of the first audible alarm signal from said smoke detector;

said sensing circuit providing an electrical warning signal upon detection of the first audible alarm signal or in response to the detection of a low water condition within said tree stand;

said shut-off mechanism including:

a secondary AC receptacle for electrically coupling with said Christmas tree ornamentation equipment, said secondary electrical receptacle being electrically coupled with said existing AC receptacle;

means for interrupting current supplied from said existing AC receptacle to said secondary AC receptacle in the event of either a sensed low water level condition within said tree stand or the detection of said first audible alarm signal;

whereby upon detection of the first audible alarm signal or said lower water level condition said current interrupting means causes power supplied from existing AC receptacle to said secondary AC receptacle to be interrupted, thereby causing power to said Christmas tree lights to be interrupted; and a second audible alarm responsive to said electrical warning signal for generating a second audible alarm signal indicative of a warning condition representing either a low water level condition or the detection of said smoke.

2. The apparatus of claim 1, wherein said shut-off mechanism includes a visual alarm indicator for providing a visual indication of an alarm condition.

3. The apparatus of claim 1, wherein said low water level sensor includes a water sensing probe removably Coupled to said shut-off mechanism.

4. The apparatus of claim 3, wherein said low water level sensor includes a pair of probe leads which are integral with said tree stand.

5. A fire safety apparatus for monitoring the operation of electrical Christmas tree ornamentation equipment supported on a Christmas tree, said apparatus comprising:

a low water level detector for detecting a low water level within a tree stand in which a portion of said Christmas tree is disposed, said low water detector having a low water detector circuit for detecting the presence of low water and generating an electrical alarm signal in response to the detection of a low water condition;

a smoke detector releasably securable to a portion of said Christmas tree, said smoke detector having a smoke detector circuit for detecting the presence of smoke and a first audible alarm for generating a first audible alarm signal in response to the detection of smoke in the vicinity of said Christmas tree;

a monitoring/shut-off mechanism adapted to be removably electrically coupled to an existing AC wall receptacle and also coupled to said low water level detector, said shut-off mechanism including a microcomputer adapted to receive said first audible alarm signal and coupled to said smoke detector via at least one electrical conductor for receiving an electrical signal via said electrical conductor indicative of the presence of smoke in the vicinity of said Christmas tree, said microcomputer further being adapted to monitor the integrity of said electrical conductor and to cause a signal to be generated in the event of damage to said electrical conductor;

said microcomputer providing said power shut-off signal Upon receipt of the electrical signal, upon generation of the first audible alarm signal, and in response to the detection of a low water condition within said tree stand;

said monitoring/shut-off mechanism further including:

a secondary AC receptacle for electrically coupling with said Christmas tree ornamentation equipment, said secondary electrical receptacle being electrically coupled with said existing AC receptacle;

means responsive to said power shut-off signal for interrupting current supplied from said existing AC receptacle to said secondary AC receptacle in the event of either a sensed low water level condition within said tree stand or the detection of said first audible alarm signal;

whereby upon generation of the first audible alarm signal or said lower water level condition, said current interrupting means causes power supplied from existing AC receptacle to said secondary AC receptacle to be interrupted, thereby causing power to said Christmas tree ornamentation equipment to be interrupted; and a second audible alarm responsive to said signal for generating a second audible alarm signal indicative of a warning condition representing either a low water level condition or the detection of said smoke.

* * * * *